United States Patent [19]

Schladitz

[11] 3,943,221

[45] Mar. 9, 1976

[54] APPARATUS FOR ATOMIZING AND/OR VAPORIZING LIQUID IN A STREAM OF GAS

[76] Inventor: Hermann J. Schladitz, Plaentschweg 74, Munich 60, Germany

[22] Filed: Nov. 16, 1973

[21] Appl. No.: 416,655

[30] Foreign Application Priority Data

Nov. 17, 1972 Germany ..... 2256500

[52] U.S. Cl. ..... 261/142; 261/98; 29/455 R; 29/420; 228/198

[51] Int. Cl.[2] ..... B01F 3/04

[58] Field of Search ..... 261/94, 98, 142; 23/288 R, 23/288 J; 29/455, 420; 228/198

[56] References Cited

UNITED STATES PATENTS

| | | | |
|---|---|---|---|
| 1,396,389 | 11/1921 | Whitaker | 23/288 J |
| 1,941,487 | 1/1934 | Portail | 261/94 |
| 2,054,809 | 9/1936 | Fleisher | 261/98 |
| 3,672,824 | 6/1972 | Tamura et al. | 23/288 R |
| 3,826,895 | 7/1974 | Schladitz | 219/382 |

FOREIGN PATENTS OR APPLICATIONS

| | | | |
|---|---|---|---|
| 1,096,375 | 12/1967 | United Kingdom | 219/382 |
| 933,124 | 8/1963 | United Kingdom | 261/94 |
| 286,269 | 1929 | United Kingdom | 261/94 |

*Primary Examiner*—Tim R. Miles
*Attorney, Agent, or Firm*—Kane, Dalsimer, Kane, Sullivan and Kurucz

[57] ABSTRACT

Apparatus for atomising and/or vaporising a liquid in a stream of gas employs a porous body wetted by the liquid and through which the gas is passed. The body is composed of a number of generally parallel lines of porous rope-like bundles made up from whiskers. These may be polycrystalline metal whiskers or metallised non-metallic whiskers. The gas flow is parallel to the lines, which have passages between them. Provision can be made for heating the body and the liquid distribution may be aided by a coarser porous member upstream of the body.

6 Claims, 5 Drawing Figures

APPARATUS FOR ATOMIZING AND/OR VAPORIZING LIQUID IN A STREAM OF GAS

The invention relates to an apparatus for atomising and/or vaporising a liquid in a stream of gas, the apparatus having a porous substance through which the stream of gas flows and which becomes wetted by the liquid.

In many fields of technology, the problem arises of charging a stream of gas with a liquid, whereby in many cases atomising, in other words the breaking of the liquid down into the smallest possible droplets, is adequate while in other cases it is necessary to convert the liquid to vapour form. Known fields of application are air humidifying plants which maintain the atmospheric humidity in industrial or dwelling places, greenhouses or the like, particularly when they are also being heated at a definite level. Another field of application relates to the preparation of fuel-air mixtures in internal combustion engines, where it is desirable to atomize and possibly varporise the relatively large droplets of fuel in the fuel-air mixture formed in the carburettor. For this purpose, it is known to dispose a filter which may be heatable, between the carburettor and the combustion chamber.

A porous body of this type ought to have a large pour volume in order to minimise resistance to flow. The internal surface area of the porous body should likewise be large since the best results are achieved when only the surfaces of the walls defining the pores are wetted with liquid and, where there is a large internal surface area, considerable quantities of liquid can be entrained by the stream of gas.

Such a porous body should also have a high mechanical strength so that it is not compressed by the pressure of the gas stream, its pores becoming more or less occluded. Finally, the porous body should exhibit good heat conductivity in order to improve the atomizing or vaporising of the liquid by drawing heat from the stream of gas or from the ambient, or possibly in order to allow electrical heating.

Most known porous bodies only incompletely fulfil the aforesaid requirement. Foamed substances, particularly those based on plastics material, have inadequate strength and poor heat conductivity. Porous bodies consisting of sintered metal power do, it is true, have a relatively high strength but only a relatively small pore volume of a maximum of approximately 40%. Closest to the requirements is a known electrical heating element which consists of a highly porous skeleton of a plurality of metallically interconnected polycrystalline metal whiskers, which is traversed by the medium to be heated and it is preferably heated by direct passage of electrical current. This element can in principle also be used in a stream of gas without heating, for the atomizing or vaporising of liquids, since it has on the one hand a high pore volume and on the other high strength properties. Such polycrystalline metal whiskers (see for example *Seitschrift fur Metallkunde* Vol. 59 (1968), No. 1, pp. 18 to 22), are characterised by very high strength and they can therefore by made into a skeleton in thicknesses of a few $\mu$um to less than 1 $\mu$um, the skeleton readily withstanding the flow pressures which occur. This known element consists of a mat or a felt of unorientated or random whiskers which are connected metallically to one another by metal separation from the gaseous phase, by electrolytic or currentless metal deposition, by sintering, hot-moulding, electron beam welding, ultra-sonic welding or other methods. However, for many applications, such an element offers too high a resistance to flow.

The invention is based on the problem of providing a porous body which fulfils the aforementioned requirements to the greatest possible degree and which has a lower resistance to flow than the last-mentioned heating element.

According to the present invention there is provided apparatus for atomizing and/or vaporising a liquid in a stream of gas, having a porous body traversed by the stream of gas and wetted by the liquid, wherein the improvement comprises the construction of the porous body as a plurality of highly porous lines orientated substantially parallel with the direction of flow of the gas and which are formed by interconnected polycrystalline metal whiskers or metallised non-metallic whiskers, the lines forming between them passages through which the gas can flow.

With orientation of the lines parallel with the direction of flcw of the gas, it is possible largely to avoid turbulence in the flow of gas, such turbulence being inevitable with unorientated whiskers. By virtue of the orientation of the whiskers and the high pore volume of the porous body, which may readily amount to 92% of the total volume, only the individual lines of whiskers become wetted with the liquid. This thin film is entrained by the flow of gas, and may be atomized or in many cases, even without heating, evaporation or vaporising of the liquid takes place. Of substantial importance to this effect is the construction of each line of whiskers, which consists of a plurality of individual substantially parallel whiskers overlapping along the length of the line, so that a very large surface area is achieved. These lines of whiskers are in themselves porous and due to the capillary action, liquid which penetrates the pores is being constantly given off to the stream of gas passing over the surfaces of the whiskers. This process does not only occur when, as for example in the case of air humidifying plants, water is allowed to drip onto the porous bodies, but also when liquid has been previously added to the stream of gas in the form of more or less large droplets, as is the case with the aforementioned application in the induction system of an internal combustion engine.

Where the manufacture of the porous body according to the invention is concerned, the lines of whiskers may be orientated parallel with one another by means of an homogeneous magnetic field and connected to one another in this condition.

In preference to mono-crystal whiskers, so-called thread crystals can be used. By virtue of their polycrystalline structure, polycrystalline metal whiskers have in themselves a relatively fissured or serrated surface, and so the inside surface area of the porous body according to the invention will be considerably larger than the calculated value based only on whiskers having a smooth surface. This inner surface can be further enlarged if metallic or non-metallic whiskers are used, the surfaces of which are given considerable roughness by the adoption of special measures, for example by a correspondingly controlled separation of metal from the gaseous phase.

As previously mentioned, good conductivity in the porous body is favourable to rapid atomizing or vaporising of the liquid. In consequence, according to a further preferred feature of the invention, whiskers should be used for the porous body which consist at least partially of one or more of the metals iron, nickel, aluminium, copper and silver. Since polycrystalline metal whiskers are produced by the separation of metals from thermally decomposable metal compounds, it is possible to create whiskers adapted to this particular application.

In order to facilitate, or in some cases make possible vaporising of the liquid, it may be expedient to heat the porous body, for example to provide it in known manner with electrodes for heating by the direct passage of current or to dispose it within an induction coil. Since the electrical resistance of bodies consisting of polycrystalline metal whiskers is relatively low, it may be expedient to form the porous body from a plurality of electrically serially-connected partial elements or from a spirally-coiled strip, the current connections being made to the inner and to the outer ends of the spiral.

For a better understanding of the invention, some constructional forms will now be described, by way of example, with reference to the accompanying drawings, in which.

Figure 1:
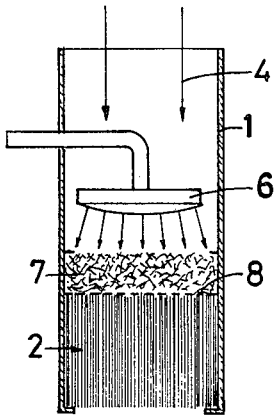
FIG. 1 is a diagrammatic sectional view of an apparatus according to the invention, suitable for humidifying air.

FIG. 1 shows a portion of an air humidifying plant which consists of a pipe 1 through which passes the air to be humidified. Inserted in the pipe 1 is a porous body 2 which consists of a plurality of lines 3 of metallically interconnected polycrystalline metal whiskers. As FIG. 2 shows, these lines 3 lie substantially parallel with one another and with the direction of flow of the air illustrated by the arrows 4.

Figure 2:
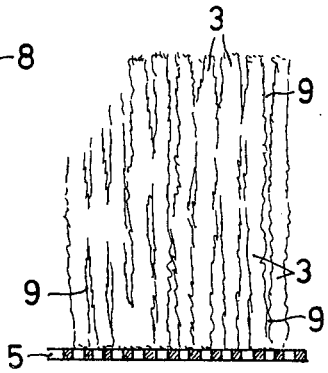
FIG. 2 shows on a greatly enlarged scale a detail of the porous body contained in the apparatus of FIG. 1.
Figure 3:
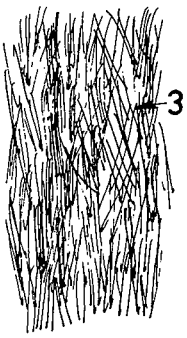
FIG. 3 is a detail of a line of whiskers of the porous body shown in FIG. 2, on a further enlarged scale.
Figure 4:
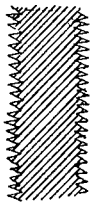
FIG. 4 shows on a yet further enlarged scale a detail of a single whisker.

Each line of whiskers is formed by a plurality of single poly-crystalline whiskers or bundles of whiskers which, in an homogeneous magnetic field, form themselves into the lines which can be seen in FIG. 2, their ends not abutting one another but overlapping as shown in FIG. 3. Thus, there is a relatively broken-up surface on each line of whiskers. Since also the whiskers themselves may have a vary rough or serrated surface, as illustrated in FIG. 4, the total inner and outer surface area of each line of whiskers is correspondingly great. The connection of the whiskers or bundles of whiskers forming a line is effected preferably by separation of a metal from the gaseous phase, for example by thermal decomposition of a metal carbonyl. The same method can be applied in order to connect the lines 3 of whiskers to one another and possibly one or both line ends to a porous plate 5. The whiskers may have a diameter of a few $\mu$m down to below 1 $\mu$um. The thickness of the metal deposit connecting the whiskers is preferably below 1 $\mu$um. This deposition of metal is so controlled that open pores are left in the individual lines of whiskers.

Although the lines 3 of whiskers are very densely packed and the porous body 2 gives the impression of being a relatively compact body, a pore volume of over 90% can be achieved. By orientating the lines 3 of whiskers parallel with the direction of flow 4 of the air, the resistance to flow is extraordinarily low.

For humidifying air water is introduced into the pipe 1 upstream of the porous body 2 by a spray 6. The water droplets are distributed over the end surface 8 of the porous body 2 by a porous insert 7 disposed in front of the porous body 2 and consisting in this example of a relatively coarse skeleton of random whiskers, which may also be polycrystalline metal whiskers. The water is drawn by capillary action into the spaces 9 between the individual lines 3 of whiskers and into the pores between the whiskers. This results in virtually complete wetting of all whiskers in the lines 3. The air flowing through the porous body 2 entrains the stream of water created on the surface of the lines of whiskers 3, so that the stream of water is atomized and partially vaporised, and at the same time the water present in the pores of the lines 3 of whiskers is extracted as a mist or vapour. The stream of air emerging from the porous body 2 is charged with water vapour and with extremely fine droplets of water.

Since the polycrystalline metal whiskers and thus the lines 3 of whiskers have an extraordinarily high strength, even at high flow pressures, there is no danger of the porous body 2 being compressed. All that can happen is that the air flows not only through the intermediate spaces 9 between the lines 3 of whiskers but also directly through the pores in the individual lines 3 of whiskers. However, this is rather more advantageous to the functioning of the apparatus.

Figure 5:
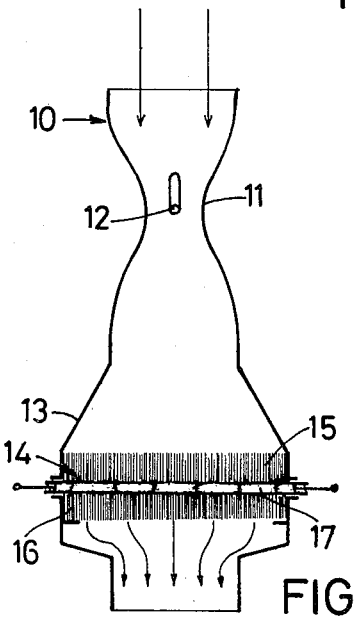
FIG. 5 is a diagrammatic sectional view of the induction system of an internal combustion engine having an apparatus according to the invention for preparing the fuel-air mixture.

FIG. 5 shows a diagrammatic sectional view of the induction system of an internal combustion engine with a carburettor 10, in the venturi tube 11 of which there is, in conventional manner, a fuel jet 12 from which the fuel is entrained by the through-flow stream of air. The fuel-air mixture thereupon flows through an insert 14 disposed in the intake pipe 13 and which in this example consists of two porous bodies 15 and 16 disposed one after another in the direction of flow and which may be constructed in generally the same way as the porous body 2 in FIG. 1. The relatively large droplets of fuel contained in the through-flowing fuel-air mixture are, upon passage through the porous insert 14, not only reduced in size but in some cases are also drawn by capillary action into the pores in the lines of whiskers from which they are given off again as vapour or mist to the passing stream of air. The fuel-air mixture emerging from the porous body 14 is characterised by a high content of fuel vapour and extremely pure droplets of fuel. This effect can be further intensified if the porous insert 14 is heated. This can be achieved for example if the insert is in heat-conductive connection with a hear carrier, for instance the heated cooling water or lubricating oil of an internal combustion engine or air heated by the exhaust system, or if it is electrically heated. In this example, there is between the porous bodies 15 and 16 a heating coil 17 which either accommodates an electric heating wire or has a heat carrier flowing through it.

The invention is not limited to the specific examples illustrated or to the fields of application particularly mentioned.

I claim:

1. Apparatus for atomizing and/or vaporizing a liquid in a stream of gas comprising; conduit means and a porous body therein, a source of gas connected to the conduit means, a source of liquid connected to the conduit means so that both gas and liquid are supplied to said porous body, the porous body being a plurality of highly porous lines oriented substantially parallel with the direction of flow of the gas and which are formed by interconnected polycrystalline metal whiskers or metallized non-metallic whiskers, the lines consisting of a plurality of individual substantially parallel whiskers overlapping along the length of the line, the lines forming between them passages through which the gas can flow with the overlapping whiskers providing larger spaces to facilitate flow of the gas through the passages and the passages extending to the downstream end of the whiskers and being open at the downstream end.

2. The invention in accordance with claim 1 wherein a porous insert having relatively large pores which distribute the liquid over the end face of the porous body is upstream of the porous body in relation to the gas flow, and the porous insert being formed by a coarse skeleton of non-oriented polycrystalline metal whiskers.

3. The invention in accordance with claim 1 wherein the whiskers have a serrated surface.

4. The invention in accordance with claim 1 wherein the whiskers consist at least partially of at least one of the group of metals, iron, nickel, aluminum, copper and silver.

5. The invention in accordance with claim 1 wherein means are provided for heating the porous body.

6. The invention in accordance with claim 5 wherein the porous body is formed from two spaced elements, the heating means being a heating coil between said elements.

* * * * *